United States Patent [19]

Iyoki et al.

[11] 4,251,248

[45] Feb. 17, 1981

[54] METHOD AND APPARATUS FOR AUTOMATIC CHANGE OF OPERATIONS IN AIR SEPARATION PLANT

[75] Inventors: Takeshi Iyoki; Taichi Katsuki; Takumi Mizokawa; Takaharu Goto, all of Kobe, Japan

[73] Assignee: Kobe Steel, Limited, Kobe, Japan

[21] Appl. No.: 36,015

[22] Filed: May 4, 1979

Related U.S. Application Data

[63] Continuation-in-part of Ser. No. 839,355, Oct. 4, 1977, abandoned.

[30] Foreign Application Priority Data

Oct. 4, 1976 [JP] Japan ..... 51-119534

[51] Int. Cl.[3] ..... F25J 3/04

[52] U.S. Cl. ..... 62/21; 62/37

[58] Field of Search ..... 62/21, 37

[56] References Cited

U.S. PATENT DOCUMENTS 2,730,875 1/1956 Ranke ..... 62/21

3,912,476 10/1975 Mikawa et al. ..... 62/21

*Primary Examiner*—Norman Yudkoff

*Attorney, Agent, or Firm*—Oblon, Fisher, Spivak, McClelland & Maier

[57] ABSTRACT

A method and apparatus for automatic change of operations in an air separation plant in increasing or decreasing the amounts of products. The present invention is characterized in that intended change values of the flow rate of feed air to be introduced into an air separation plant, the flow rate of liquid air recycled to an upper tower from a lower tower of a rectification column, the flow rate of recycled liquid nitrogen and the flow rate of an expansion turbine gas flowing in an expansion turbine are computed from the values of increased or decreased amounts of products. At the time of initiation of change of the flow rates, the ratio of the flow rate of feed air to the flow rate of the product is increased, and the flow rates of the feed air, recycled liquid air, recycled liquid nitrogen, expansion turbine gas and product are automatically changed to the intended values while gradually reducing the above ratio, and the period ranging from the point at which the intended values are attained to the point when the unstable operation state in the air separation plant is completed is set as the operation change-inhibiting period and the subsequent change of the flow rates is inhibited during this period.

8 Claims, 12 Drawing Figures

FIG. 1
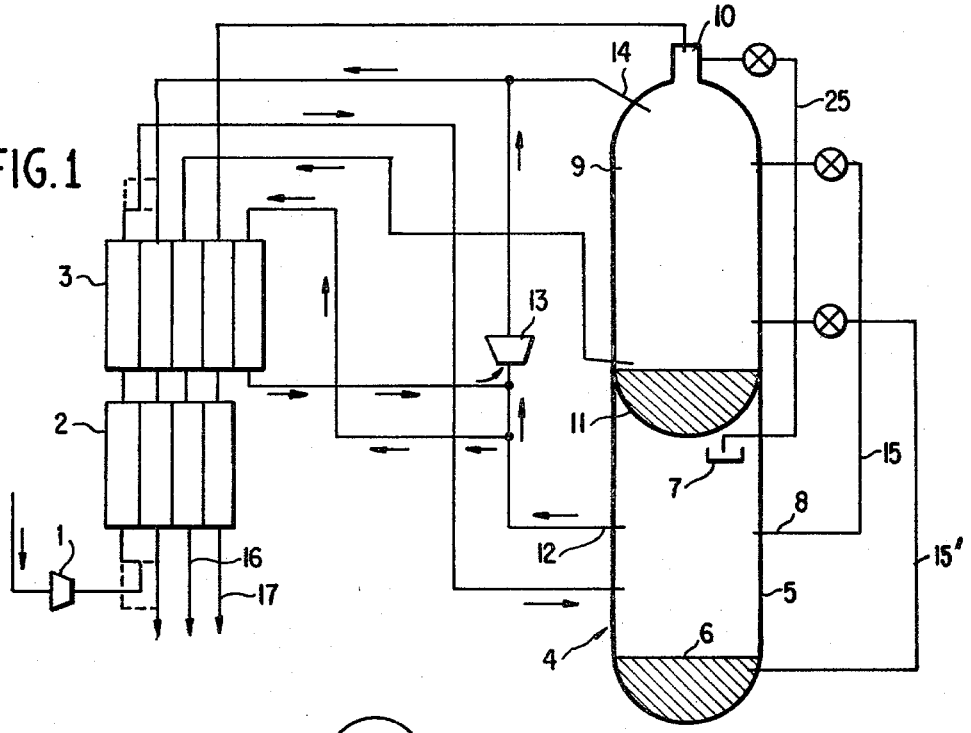
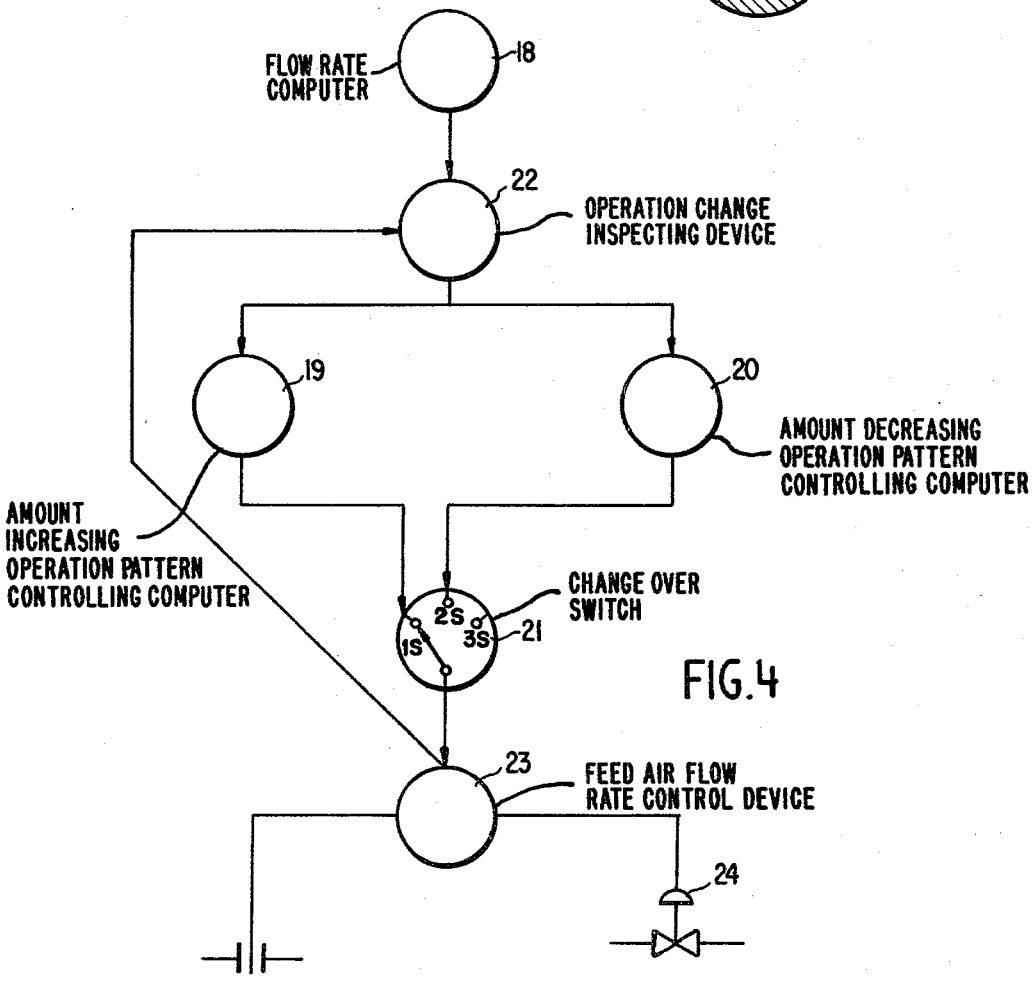
FIG. 4

METHOD AND APPARATUS FOR AUTOMATIC CHANGE OF OPERATIONS IN AIR SEPARATION PLANT

This application is a continuation-in-part of application Ser. No. 839,355, filed Oct. 4, 1977, and now abandoned.

BACKGROUND OF THE INVENTION

1. Field of the Invention

The present invention relates to a method and apparatus for automatic change of operations in an air separation plant in increasing or decreasing the amounts of products.

2. Description of the Prior Art

Operations in an air separation plant have heretofore been performed manually, and also operations of changing the amounts of product oxygen and product nitrogen in follow-up of changes in comsumption thereof have been performed manually. The equipment scale of an air separation plant is large and the heat capacity and mass capacity thereof are also large. Accordingly, a long time period is required for the so-called operation change, namely the change of the operation state from one steady operation state to another steady operation state, and further, since product oxygen and product nitrogen are continuously fed to steps using these products even during the operation change, it is required that supply of products inferior in quality is not allowed even for a very short time period. Accordingly, it is difficult to economically perform changing of outputs of products in follow-up of the comsumption thereof according to manual procedures.

SUMMARY OF THE INVENTION

It is a primary object of the present invention to provide a method and apparatus in which in increasing or decreasing the amounts of product oxygen and/or product nitrogen from an air separation plant in follow-up of changes of the consumption of product oxygen and/or product nitrogen, the operation change is automatically performed while the air separation plant is operated stably and economically.

A secondary object of the present invention is to provide a method and apparatus in which the amounts of product oxygen and/or product nitrogen can be decreased or increased without degradation of the quality of the products.

A third object of the present invention is to provide a method and apparatus in which the operation change and detection of the completion of the operation change can be performed automatically.

In accordance with a first aspect of the present invention, the foregoing objects can be attained by a method for automatically changing operation in an air separation plant for increasing or decreasing the amount of a product, which comprises computing intended change values of the flow rate of feed air to be introduced into the air separation plant, the flow rate of liquid air recycled to an upper tower from a lower tower of a rectification column, the flow rate of recycled liquid nitrogen and the flow rate of an expansion turbine gas flowing in an expansion turbine, from the value of the increased or decreased amount of the product, increasing the ratio of the flow rate of feed air to the flow rate of the product at the time of initiation of change of the flow rates, automatically changing the flow rates of the feed air, recycled liquid air, recycled liquid nitrogen, expansion turbine gas and product to the intended values while gradually reducing said ratio, and setting the period ranging from the point at which the intended values are attained to the point at which the unstable operation state in the air separation plant is completed, as the operation change-inhibiting period, during which the subsequent change of the flow rates in inhibited.

In accordance with a second aspect of the present invention, there is provided a method as set forth in the first aspect, wherein in case of increasing the amount of the product, the change of the flow rate of feed air is initiated prior to the change of the flow rate of the product and in case of decreasing the amount of the product, the change of the flow rate of the product is initiated prior to the change of the flow rate of feed air.

In accordance with a third aspect of the present invention, there is provided a method as set forth in the first or second aspect, whrein when a disorder takes place in measuring means or control loops of the air separation plant, the change of the flow rates of the feed air, recycled liquid air, recycled liquid nitrogen, expansion turbine gas and product is temporarily stopped until the normal state is restored.

In accordance with a fourth aspect of the present invention, there is provided a method as set forth in any of the first, second and third aspects, wherein an allowable time for the change of the flow rates is predetermined and if the change of the flow rates is not completed within said allowable time, the change of the flow rates is stopped in the operation state at this point.

In accordance with a fifth aspect of the present invention, there is provided an apparatus for automatically changing operations in an air separation plant for increasing or decreasing the amount of a product, which comprises a flow rate computer for computing intended change values of the flow rate of feed air to be introduced into the air separation plant, the flow rate of liquid air recycled to an upper tower from a lower tower of a rectification column, the flow rate of recycled liquid nitrogen and the flow rate of an expansion turbine gas flowing in an expansion turbine, from the value of the increased or decreased amount of the product, an operation pattern control computer for determining a change pattern for changing the flow rates of the feed air, recylced liquid air, recycled liquid nitrogen, expansion turbine gas and product to said intended change values, a flow rate control device for actuating and controlling flow rate control valves for adjusting the flow rates of the feed air, recycled liquid air, recycled liquid nitrogen, expansion turbine gas and product based on set values of the flow rates emitted from said operation pattern control computer, and operation change-inspecting device for comparing the intended change values from said flow rate computer with the set values of the flow rates from said operation pattern control computer and judging completion of the operation change.

In accordance with a sixth aspect of the present invention, there is provided an appratus as set forth in the fifth aspect, wherein said operation pattern control computer includes a control mechanism for temporarily stopping computation of the change pattern on receipt of a signal indicating occurrence of a disorder in a measuring member or control loops in the air separation plant.

In accordance with a seventh aspect of the present invention, there is provided an apparatus as set forth in the fifth or sixth aspect, wherein the operation change-inspecting device includes a timer member for measuring an allowable time for the operation change and an operation change-inhibiting time and an alarm member for indicating the lapse of said times.

BRIEF DESCRIPTION OF THE DRAWINGS

Various other objects, features and attendant advantages of the present invention will be more fully appreciated as the same becomes better understood from the following detailed description when considered in connection with the accompanying drawings, in which like reference characters designate like or corresponding parts throughout the several views, and wherein:

FIG. 1 is a flow chart illustrating an air separation plant.

FIG. 4 is a flow chart illustrating a computer for controlling the flow rate of feed air according to the present invention.

DETAILED DESCRIPTION OF THE PREFERRED EMBODIMENTS

Figure 3:
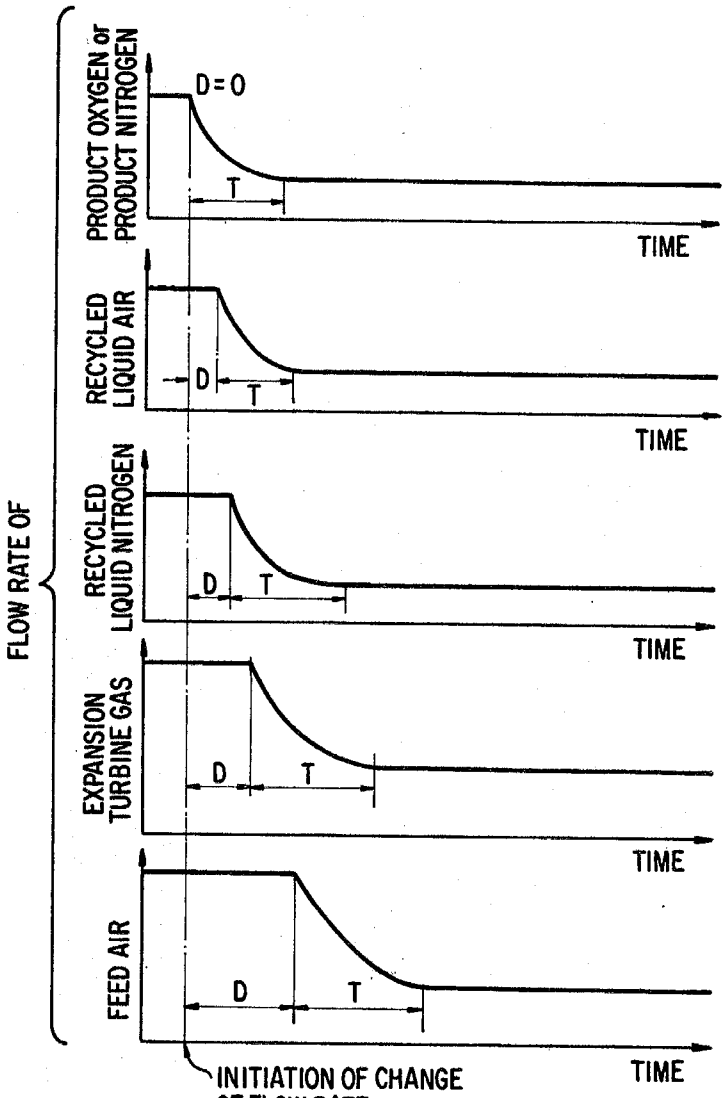
FIG. 3 is a diagram illustrating an operation pattern in the operation of decreasing the amount of a product.

An air separation plant will now be outlined by reference to the flow chart of FIG. 1. Feed air supplied by an air compressor 1 is passed through a plurality of reversing heat exchangers 2 and 3 (two heat exchangers are shown in the drawing) and is cooled to about −170° C. Then, it is introduced into a lower tower 5 of a rectification column 4. The feed air introduced into the lower tower 5 is preliminarily rectified and liquid air having an $O_2$ purity of about 40% is stored in the lower portion 6 of the lower tower 5 while nitrogen gas is stored in the upper portion of the lower tower 5. This nitrogen gas is taken out to the outside of the lower tower 5 and cooled by a main condenser (not shown) and is again introduced into the lower tower 5 in the form of liquid nitrogen and stored in a distribution tank 7.

Liqiud air (40% $O_2$) in the lower portion 6 of the lower tower 5, liquid air having a nitrogen purity of 96% which has been taken out from the intermediate portion 8 of the lower tower 5, and liquid nitrogen in the distribution tank 7 are introduced via conduits 15', 15 and 25, respectively, into an upper tower 9 of the rectification column 4 and are further rectified. Thus, a nitrogen gas having a purity of about 99.999% is stored in the top 10 of the upper tower 9 and liquid oxygen having a purity of about 99.6% is stored in the bottom portion 11 of the upper tower 9. The nitrogen gas having a purity of about 99.999% is taken out from the top 10 of the upper tower 9 and introduced into the reversing heat exchangers 3 and 2, while an oxygen gas having a purity of about 99.6% is taken out from the point just above the bottom 11 of the upper tower 9 and is similarly introduced into the reversing heat exchangers 3 and 2 to cool feed air. Feed air is cooled in the reversing heat exchangers 2 and 3 with nitrogen and oxygen separated in the rectification column 4 as cooling media. In order to prevent clogging of the heat exchangers 2 and 3 with $CO_2$, $H_2O$ and the like in feed air, which will be described hereinafter, it is necessary to maintain a temperature difference of about 4° C. between feed air and nitrogen and oxygen as the cooling media. Accordingly, a part of air is withdrawn from the intermediate portion 12 of the lower tower 5 of the rectification column 4. All or part of the thus withdrawn air is introduced into the reversing heat exchanger 3 to maintain the above temperature difference suitable for attaining a high effeiciency in the heat exchangers. The withdrawn gas from the reversing heat exchanger 3 is introduced into an expansion turbine 13 and performs an external thermodynamic work (adiabatic expansion) to generate the coldness necessary for the air separation plant. Then, the withdrawn gas is mixed with a nitrogen gas having a purity of about 99.99% from the upper portion 14 of the upper tower 9 of the rectification column 4 and after it has passed through the reversing heat exchangers 3 and 2 to cool feed air by the heat exchange, it is discharged into the open air in the form of an exhaust nitrogen gas.

Impurities in feed air, such as $CO_2$, $H_2O$ and CO, adhere to the wall of a pipe forming an air channel in the reversing heat exchangers 2 and 3, and the air channel is clogged. Accordingly, this air channel is periodically changed over with a channel for the above-mentioned exhaust nitrogen gas. When changeover of the channels in conducted. $CO_2$, $H_2O$, CO and the like adhering to the pipe wall are carried by the exhaust nitrogen gas and discharged into the open air.

In order to automatically perform the operation change in the air separation plant, the following requirements should be satisfied:

(a) since product oxygen and product nitrogen are continuously fed to consumers even during the operation change, the feeding out of low quality products for even a very short time must be avoided;

(b) the operation change must not be influenced by changes of characteristics owing to unsuitable control parameters or changes of equipments with the lapse of time, (c) when the operation change is impossible, this state is detected as a disorder; and (d) completion of the operation change is detected assuredly and promptly.

The method for automatically changing operations in an air separator plant according to the present invention has been developed as a method satisfying all of the foregoing requirements (a) to (d) completely. The characteristic features of the present invention will now be described.

(1) In the air separation plant, feed air is liquefied and is separated into oxygen and nitrogen by utilizing the difference of the boiling point between them. As a parameter indicating the operation state, there can be mentioned a ratio of the flow rate of feed air to the flow rate of product oxygen. This ratio indicates the amount ($Nm^3$/hr) of air necessary for the production of 1 $Nm^3$/hr of oxygen, and a lower ratio of the flow rate of feed air to the flow rate of product oxygen means a higher operation efficiency. When the ratio of the flow rate of feed air to the flow rate of product oxygen is high, the operation efficiency is low, but since air is used in an amount necessary for production of the required amount of the product oxygen gas, the air separation process is in a remarkably stable state and the operation state has a very high resistance to disturbances. In the method for automatically changing operations in the air separation plant according to the present invention, this ratio of the flow rate of feed air to the flow rate of product oxygen gas is taken into account. More specifically, in the initial stage of the operation change, control is made so that the above ratio is enhanced to maintain a remarkably stable state in the process, and then, this ratio is gradually reduced and returned to the normal value. By this control of the ratio of the flow rate of feed air to the flow rate of product oxygen, the operation change can be accomplished while always keeping the air separation process stable against disturbances, and reduction of the quality in product oxygen and product nitrogen can be prevented even during the operation change.

(2) In increasing or decreasing the amount of product oxygen and/or product nitrogen, the flow rate of feed air to be introduced into the air separation plant, the flow rate of liquid air recycled to the upper tower from the lower tower of the rectification column, the flow rate of recycled liquid nitrogen and the flow rate of the gas flowing in the expansion turbine are computed from a variable corresponding to the difference of the present flow rates of product oxygen and product nitrogen based on a predetermined relation formula.

After the intended change values have been determined by computation, the change of the flow rates of the feed air, recycled liquid air, recycled liquid nitrogen, expansion turbine gas and products is initiated and conducted until the intended change values are attained. More specifically, in the case where the amount of products are increased, the change of the flow rate of the feed air (the change for increasing the flow rate) is first initiated, and then, the change of the flow rates of the products is initiated. In contrast, in the case where the amounts of the products are decreased, the change of the flow rates of the products in first initiated prior to initiation of the change of the flow rate of the feed air. In this manner, at the start of the change of the flow rates, the ratio of the flow rate of the feed air to the flow rate of the product can be enhanced.

(3) Just after completion of the operation change, the thermal balance or material balance is still unstable in the air separation plant. Accordingly, an operation change-inhibiting time is set for waiting for the process to become stable. Subsequent operation changes are inhibited until this operation change-inhibiting time passes from completion of the precedent operation change.

(4) When the operation change is initiated, control is made so that the ratio of the flow rate of the feed air to the flow rate of the product oxygen in first enhanced and this ratio is finally reduced. This control is accomplished in the following manner. Namely, only when all of the indicators and control loops in the air separation process are in the normal state, the system is operated so that the ratio of the flow rate of the feed air to the flow rate of the product oxygen is reduced, and when any one of the indicators and control loops is in the abnormal state, the operation is stopped temporarily until the normal state is restored in each of the indicators and control loops and the process becomes stable, and the operation is started again after the normal state has been restored.

(5) Completion of the operation change is judged and detected by completion of the control for reduction of the ratio of the flow rate of the feed air to the rate of the product oxygen to the predetermined value.

(6) An allowable time for the operation change is set depending on the intended operation change, and if the change of the flow rates is not completed within the allowable time, the change of the flow rates is temporarily stopped in the operation states at this point and simultaneously this is indicated to the operator by the alarm member for checking occurrence of a disorder in the operation and detecting a cause thereof.

The method for automatically changing operations in an air separation plant according to the present invention is characterized by the foregoing features (1) to (6).

Operations of increasing and decreasing the amounts of product oxygen and product nitrogen in the method of the present invention for automatically changing operations in an air separation plant will now be described in detail by reference to embodiments illustrated in the drawings.

Figure 2:
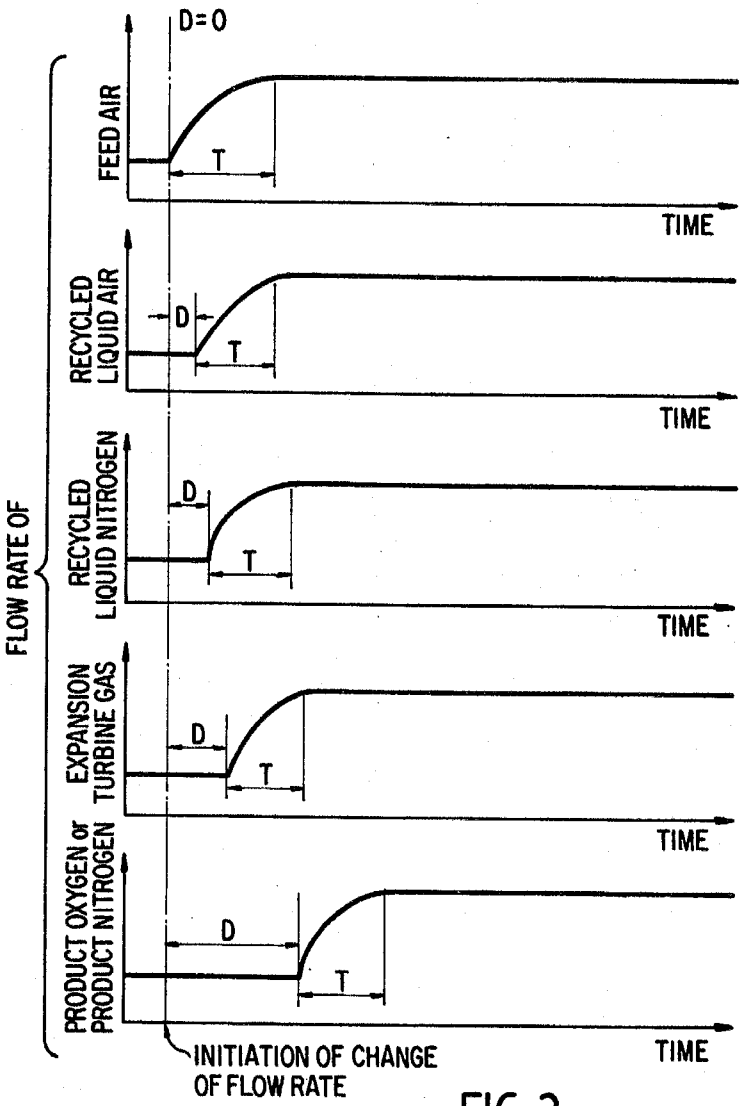
FIG. 2 is a diagram illustrating an operation pattern in the operation of increasing the amount of a product.
Figure 5A:
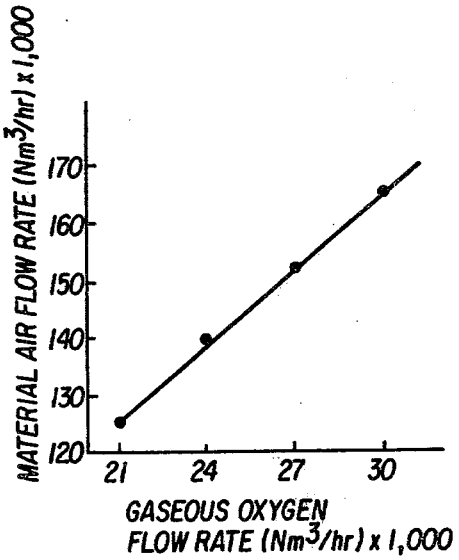
FIGS. 5A–5D set forth graphs utilized in determining the operational data of each control system suitable to each product amount.
Figure 5B:
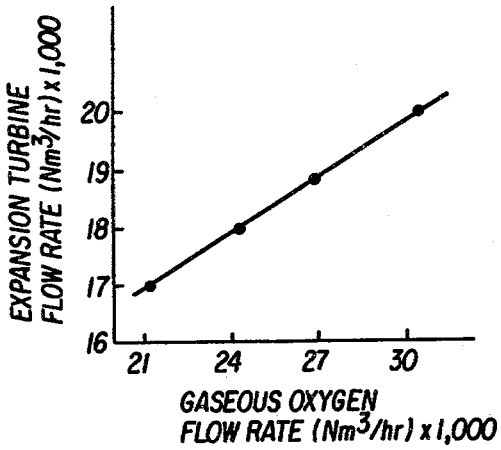
Figure 5C:
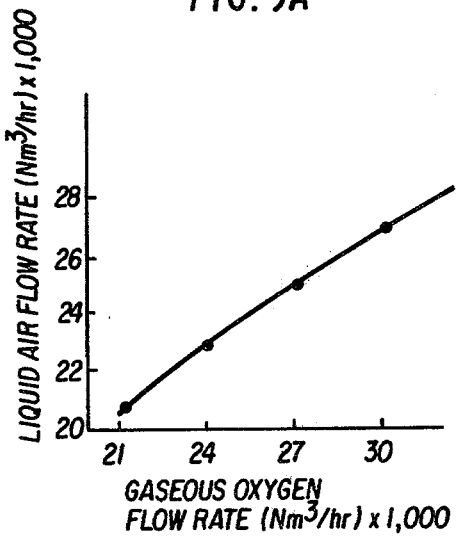
Figure 5D:
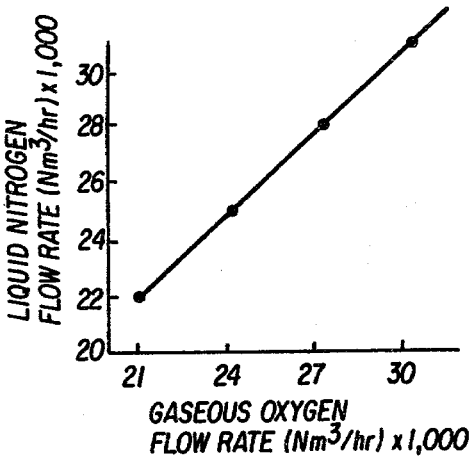

FIG. 2 is a view illustrating the operation pattern for the operation of increasing the amount of the product. When the intended operation change value is given, a necessary amount of feed air, a necessary flow rate of recycled liquid air in the lower tower of the rectification column (the flow rate at 15 in FIG. 1), a necessary flow rate of recycled liquid nitrogen (the flow rate at 25 in FIG. 1), a necessary flow rate of the expansion turbine gas (the flow rate at 13 in FIG. 1) and necessary flow rates of product oxygen and nitrogen (the flow rates at 16 and 17 in FIG. 1) are determined from the results of the past operations.

The amount-increasing operation pattern is composed of these necessary flow rates, dead times (D) and time constants (T). By determining the dead time (D) and time constant (T) with respect to each of the operations of changing these flow rates, it is possible to initiate the operation change in the direction improving the purity of product oxygen and nitrogen. In other words, the dead times (D) are gradually increased according to the sequence of initiation of the operations.

FIG. 3 is a view illustrating the operation pattern for the operation of decreasing the amount of the product. In this case, the dead times (D) are set in a manner different from the manner adopted in FIG. 2. Namely, the dead time (D) for the operation of changing the flow rates of product oxygen and nitrogen is shortest because this operation is first conducted, and the dead time (D) for the operation of changing the flow rate of feed air is longest because this operation is finally conducted. This arrangement is made so that, as described hereinbefore, the ratio of the flow rate of feed air to the flow rate of product oxygen is first enhanced at the start of the operation to keep the process stable against disturbances.

The sequence or order of changing the flow rates of recycled liquid air, recycled liquid nitrogen and expansion turbine gas is not limited to one illustrated in FIG. 2 or 3, and dead times (D) need not always be set for changing these flow rates and it is possible to initiate the operations of changing these flow rates simultaneously.

FIG. 4 is a flow chart of a feed air flow rate controlling computer in the method for automatically changing operations in an air separation plant by using control computers.

Reference numeral 18 represents a flow rate computer for computing a necessary flow rate of feed air based on given intended values of product oxygen and nitrogen. Reference numeral 19 represents an amount-increasing pattern controlling computer for expressing an amount-increasing operation pattern by dead times (D) and time constants (T) as shown in FIG. 2. Reference numeral 20 represents an amount-decreasing operation pattern controlling computer for expressing an amount-decreasing operation pattern by dead times (D) and time constants (T) as shown in FIG. 3. Reference numeral 21 represents a changeover switch in which a switch 1S is put on in the amount-increasing operation, a switch 2S is put on in the amount-decreasing operation and a switch 3S is put on in the normal steady operation.

Reference numeral 22 represents an operation change inspecting device for comparing the necessary flow rate of feed air given by the computer 18 for computing the necessary flow rate of feed air with the actual flow rate of feed air and judging whether or not the operation change has been completed. Reference numeral 23 represents a feed air flow rate control device for actuating and controlling a flow rate control valve 24 based on set values from the controlling computer 19 or 20 according to the amount-increasing or amount-decreasing operation patterns through the changeover switch 21.

When operations are changed in the air separation plant, an operator sets intended output values on the flow rate computer 18. Since the previously set intended values are stored in the flow rate computer 18, the previous and present intended values are compared with each other to judge whether increase or decrease of the output is intended, and the changeover switch 21 is set at the corresponding position. Simultaneously, the necessary flow rate of feed air is computed from the intended output value based on the past results and is indicated to the amount-increasing pattern controlling computer 19 and the amount-decreasing operation pattern controlling computer 29 through the operation change inspecting device 22. In case of increase of the output, the flow rate of feed air is computed from the operation pattern composed of dead time (D) and time constant (T) and the set value is indicated to the feed air flow rate control device 23 through the switch 1S of the changeover switch 21. Based on this set value, the control device 23 actuates and controls the control valve 24 to increase the output of feed air. In case of decrease of the output, the feed air flow rate is computed from the operation pattern by the amount-decreasing operation pattern controlling computer 20, and the set value is indicated to the feed air flow rate control device 23 through the switch 2S of the changeover switch 21. Based on this set value, the flow rate control device 23 actuates and controls the control valve 24 to decrease the flow rate of feed air. The operation change inspecting device 22 always compares the necessary flow rate of feed air given by the flow rate computer 18 with the set value fed back from the flow rate control device 23, and judges and detects attainment of the set value at the necessary flow rate of feed air.

The structure and function for increasing or decreasing the flow rate of feed air have been described. The same structure and function as shown in FIG. 4 are adopted for increasing or decreasing any of the flow rates of recycled liquid air, recycled liquid nitrogen, expansion turbine gas, product oxygen and product nitrogen shown in the operation patterns of FIGS. 2 and 3. Accordingly, illustration of examples of operations of changing these flow rates is omitted.

In the case where amounts of product oxygen and product nitrogen are increased in the air separation plant, as shown in FIG. 2, the flow rates of the feed air, recycled liquid air, recycled liquid nitrogen, expansion turbine gas, product oxygen and product nitrogen are successively increased to complete the operation change, and in the case where amounts of product oxygen and product nitrogen are decreased, as shown in FIG. 3, the flow rates of the product oxygen, product nitrogen, recycled liquid air, recycled liquid nitrogen, expansion turbine gas and feed air are successively decreased to complete the operation change. This amount-increasing or amount-decreasing operation is performed only when all of the indicators such as rates for measuring purities of product oxygen and nitrogen and a pressure gauge mounted on the upper tower of the rectification column and control loops for controlling levels of liquid air and liquid oxygen are in the normal state in the air separation plant, and when a disorder takes place in any of these indicators and control loops, computation of the operation patterns in the amount-increasing operation pattern controlling computer 19 and the amount-decreasing pattern controlling computer 20 is temporarily stopped and the computation of the operation patterns is performed again when the normal state is restored. A control mechanism for performing this control is set forth in the present invention.

The operation change inspecting device 22 includes therein a timer and alarm member for detecting the allowable time for the operation change and the operation change-inhibiting time. In the operation change, increase or decrease of the amount is performed while purities and other factors of product oxygen and nitrogen are being checked. If the operation change is completed and the intended values are attained within the predetermined allowable time, counting is immediately initiated by the timer and when the operation change-inhibiting time has passed, this is indicated to the operator by the alarming member. Thus, the operator knows that the subsequent operation change is possible.

If the intended change values are not reached even after passage of the allowable time for the operation change, occurrence of a disorder in the operation change is indicated by the alarm member and in this state, the operation change is stopped and counting of the operation change-inhibiting time is initiated by the timer.

In this case, occurrence of a disorder in the operation change only results in a failure for the output to arrive at the intended change value but it does not result in generation of a product poor in quality during the operation change. Namely, even if the air separation process is influenced by the changes of equipments with the lapse of the time or by the seasons, the influence is detected as a disorder in the operation change and formation of a product poor in quality is prevented. Accordingly, the operator can perform the automatic change of operations with a sense of security.

An example of actual automatic operation is set forth in Table I hereinbelow:

TABLE I

| STEP | OPERATIONAL PROCEDURE | DESCRIPTION |
|---|---|---|
| 1 | An operator inputs the new set value of the product amount to the control systems via flow rate computer 18 of each flow rate shown in FIG. 2. | In the case of decreasing the product oxygen amount from the present value of 30,000 $Nm^3/h$ to the new value of 28,000 $Nm^3/h$, an operator inputs the new value of 28,000 $Nm^3/h$ only to flow rate computer 18. |
| 2 | The control systems automatically calculates the new operating conditions of (1) material air flow rate, (2) expansion turbine flow rate, (3) liquid air flow rate, (4) liquid nitrogen flow rate by using, (5) the operational data in the data table of FIG. 5A–5D. | 1. Material air flow rate: the discharge flow rate of air compressor 1 in FIG. 1<br><br>2. Expansion turbine flow rate: which is taken in from 12 in FIG. 1 and flows through expansion tubine 13 in FIG. 1.<br><br>3. Liquid air flow rate: which is conducted from the lower rectification column 4 to the upper tower 9 in FIG. 1, flowing through conduit 15 in FIG. 1.<br>4. Liquid nitrogen flow rate: which is conducted from the lower tower 5 to the upper tower 9, flowing through conduit 25 in FIG. 1.<br>5. Data table: which is shown in FIG. 5A–5D |
| 3. | Subsequently, the control system check via operation change inspecting device 22 whether (a) the new operating conditions are within their specified value, and (b) if the new operating conditions are not within their specified value, the control system alarms the abnormal condition to an operator and cancels the new set value of the product amount. | 1. Whether the new operating conditions are within the specified capacity of air compressor and expansion turbine.<br><br>As for Step 1, an operator instructs the new value to flow rate computer 18 in FIG. 4, and as for Step 2, operation change inspecting device 22 checks these conditions. |
| 4. | If the new operating conditions are within the specified value, each control system transmits the new operating conditions to each control loop such as material air flow rate, expansion turbine flow rate, liquid air flow rate, liquid nitrogen flow rate. | The new operating conditions are transmitted to change inspecting device 22 in FIG. 4. |
| 5. | Before starting the transmission of the new operating conditions, each control system judges which operation change mode is required i.e., decrease or increase, and selects the suitable change pattern in accordance with the decrease or the increase and the new operating conditions are transmitted, following the change pattern. | Each control system judges the decrease or the increase by using the difference between the present set value of the product amount and the new set value.<br><br>If the present value > the new value → decrease.<br><br>If the present value > the new value → increase.<br>As for the change pattern, such is shown in FIG. 7 and 8.<br>In case of a decrease, each control system switches over switch 21 in FIG. 4 to switch 2S to the decrease pattern computer 20, and on the contrary, in case of an increase, the switch 21 is switched over to switch 1S to the increase pattern computer 19. |
| 6. | The new operating conditions of each system are transmitted following the change pattern, and the automatic change of operation is finished when all of the transmission is completed. | During automatic change of operation, operation change inspecting device 22 in FIG. 4 always checks whether the difference between the value transmitted actually through the change pattern and the new operating condition calculated by 18 is zero. When the difference becomes zero, each |

TABLE I-continued

| STEP | OPERATIONAL PROCEDURE | DESCRIPTION |
|---|---|---|
| | | control system registers the completion of the automatic change of operation and switches over the switch 21 to the normal steady operation switch 3S which connects neither computer 19 nor computer 20. |
| 7. | After completion, each control system inhibits automatic change of operation for a certain period in order to stabilize the air separation process. | |

EXAMPLE

Figure 6:
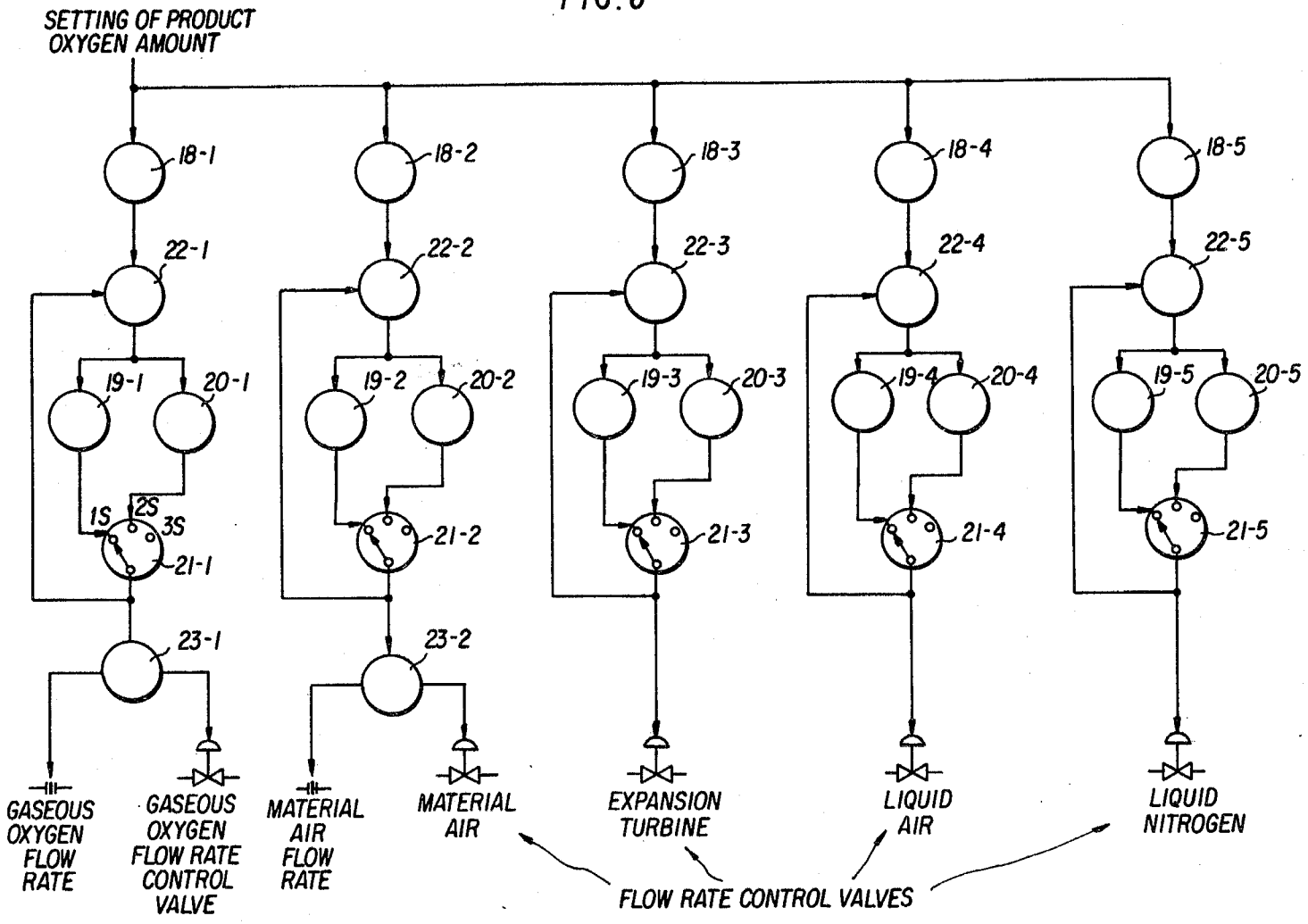
FIG. 6 discloses the feedback control function of the present invention.
Figure 7A:
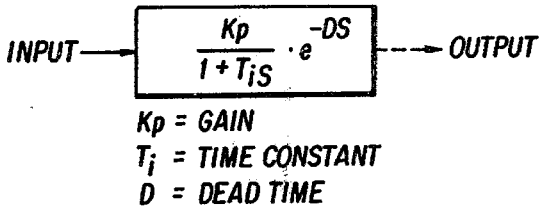
FIGS. 7A and 7B disclose the arithmetic function in the change pattern of the present invention of each control system.
Figure 7B:
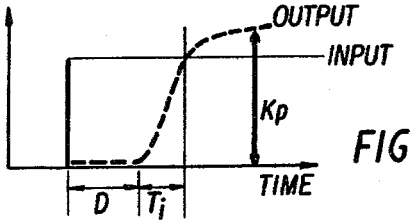
Figure 8:
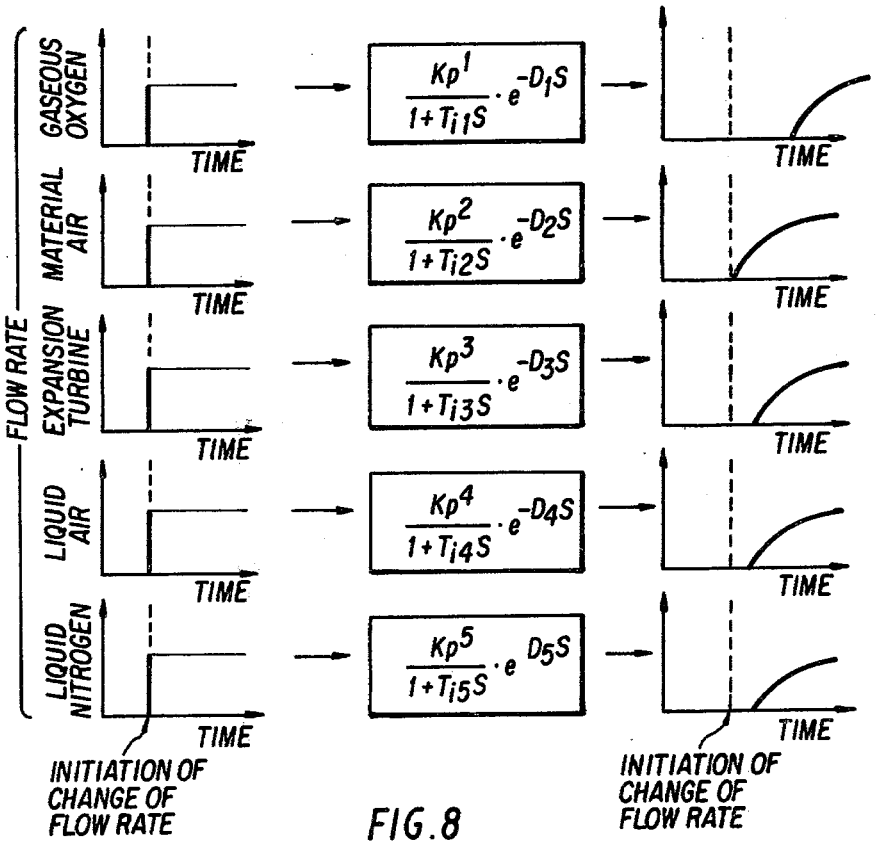
FIG. 8 discloses the manner in which the adjustment of time schedule and changing rate of transmitting new operating conditions to each control system is attained.

The operational data of each control system which is suitable to each product amount is determined on the basis of the operation experimentation and actual operational data as shown in FIGS. 5A–5D in the case where plant capacity=30,000 $Nm^3$ /hr in producing $O_2$. The above-mentioned operational data is employed as the feed forward control value, the deviation from the actual operation being compensated for by the feedback control function shown in FIG. 6. In FIG. 6, the reference numerals set forth therein represent structural elements as follows:

18-n: Flow rate computer
19-n: Amount-increasing pattern controlling computer
20-n: Amount-decreasing pattern controlling computer
21-n: Changeover switch
22-n: Operation change inspecting device
23-n: Flow rate controller
24-n: Flow rate control valve The above-noted reference numerals correspond to those set forth in FIG. 4 wherein:

n=1 for gaseous oxygen flow rate
n=2 for material air flow rate
n=3 for expansion turbine flow rate
n=4 for liquid air flow rate
n=5 for liquid nitrogen flow rate As for the change pattern, each control system employs the arithmetic function, i.e. the so-called first delay with dead time, as shown in FIGS. 7A and 7B. In this example, the values of gain ($K_p$), time constant ($T_i$), and dead time (D) relating to the change pattern in a product amount increasing operation, which are the parameters of computer 19, as shown as follows:

$K_{p1} = 1$ $K_{p2} = 1$ $K_{p3} = 1$ $K_{p4} = 1$ $K_{p5} = 1$
$T_{i1} = 15$min. $T_{i2} = 15$min. $T_{i3} = 15$min. $T_{i4} = 15$min. $T_{i5} = 15$min. $D_1 = 15$min. $D_2 = 0$min. $D_3 = 10$min. $D_4 = 10$min. $D_5 = 10$min.

On the other hand, in a product amount decreasing mode of operation, only $D_1$ and $D_2$ are different from the above data, that is, $D_1=0$ min., $D_2=15$ min. with the other parameters being equal to the above-noted data. By changing the values of dead time D, time constant T, and gain $K_p$ of the change pattern, it is possible to adjust the time schedule and changing rate of transmitting the new operating conditions to each control system which is most suitable to the decrease or increase of the product amount as shown in FIG. 8.

Advantages attained by the present invention illustrated hereinbefore are as follows:

(1) The air separation plant can be operated stably and economically in follow-up of changes in the consumption of product oxygen and product nitrogen.

(2) Product oxygen and product nitrogen poor in quality are not fed out.

(3) Since occurrence of a disorder in the operation change and completion of the operation change can be automatically judged and detected, an operator can perform automatic change of operations in the air separation plant with a sense of security.

Obviously many modifications and variations of the present invention are possible in light of the above teachings. It is therefore to be understood that within the scope of the appended claims the invention may be practiced otherwise than as specifically described herein.

What is claimed as new and desired to be secured by Letters Patent of the United States is:

1. A method for automatically changing operations in an air separation plant for increasing or decreasing the amount of a product obtained therefrom, wherein a ratio of the flow rate of feed air to be introduced into the air separation plant to product is altered, and a change to an intended value of the flow rate of feed air, a change to an intended value of the flow rate of liquid air recycled to an upper tower from a lower tower of a rectification column, a change to an intended value of the flow rate of liquid nitrogen and a change to an intended value of the flow rate of an expansion turbine gas flowing in an expansion turbine are all determined from the value of the increased or decreased amount of the product, which comprises the steps of:

increasing the ratio of feed air to product, for obtaining a desired increase in the amount of product, by first increasing the flow rate of feed air, thereafter increasing the flow rates of liquid air, liquid nitrogen and expansion turbine gas to said intended values, and then increasing the flow rate of the product; and for a decrease in the flow rate of product, increasing the ratio of feed air to product by first decreasing the flow rate of product, thereafter decreasing the flow rates of liquid air, liquid nitrogen and expansion turbine gas to said intended values, and then decreasing the flow rate of feed air.

2. A method as set forth in claim 1, wherein when a disorder takes place in the measuring means or control loops of the air separation plant, the change of the flow rates of the feed air, recycled liquid air, recycled liquid nitrogen, expansion turbine gas and product is temporarily stopped until the normal state is restored.

3. A method as set forth in claim 1, wherein an allowable time for the change of the flow rates is predetermined and if the change of the flow rates is not completed within said allowable time, the change of the flow rates is stopped in the operation state at this point.

4. A method as set forth in claim 1, wherein the product is oxygen.

5. A method as set forth in claim 1, wherein the product is nitrogen.

6. An apparatus for automatically changing operations in the air separation plant for increasing or decreasing the amount of a product obtained from the plant, which comprises:

a flow rate computer for computing intended change values of the flow rate of feed air to be introduced into the air separation plant, the flow rate of liquid air recycled to an upper tower from a lower tower of a rectification column, the flow rate of recycled liquid nitrogen and the flow rate of an expansion turbine gas flowing in an expansion turbine from the value of the increased or decreased amount of the product;

an operation pattern control computer for determining a change pattern for changing the flow rates of the feed air, recycled liquid air, recycled liquid nitrogen, expansion turbine gas and product to said intended change values, depending upon the desired change in amount of product;

control means responsive to the change pattern for first increasing the flow rate of feed air when the amount of product is to be increased, and thereafter increasing the flow rates of recycled liquid air, recycled liquid nitrogen, expansion turbine gas and then product, and for first decreasing the flow rate of product when the amount of product is to be decreased, and thereafter decreasing the flow rates of recycled liquid air, recycled liquid nitrogen, expansion turbine gas and then feed air, including control valves and a flow rate control device for actuating and controlling the control valves for adjusting the flow rates of the feed air, recycled liquid air, recycled liquid nitrogen, expansion turbine gas and product based on set values of the flow rates emitted from said operation pattern control computer; and an operation change-inspecting device for comparing the intended change values from said flow rate computer with the set values of the flow rates from said operation pattern control computer and judging completion of the operation change.

7. An apparatus as set forth in claim 6, wherein said operation pattern control computer includes a control mechanism for temporarily stopping computation of the change pattern on receipt of a signal indicating occurrence of a disorder in measuring means or control loops in the air separation plant.

8. An apparatus as set forth in claim 6, wherein the operation change-inspecting device includes timer means for measuring an allowable time for the operation change and an operation change-inhibiting time and an alarming member for indicating the lapse of said time.

* * * * *